US007985115B2

(12) United States Patent
McCloskey

(10) Patent No.: US 7,985,115 B2
(45) Date of Patent: Jul. 26, 2011

(54) PANELS FOR CONNECTOR AND ROD CONSTRUCTION TOY SETS

(76) Inventor: David C. McCloskey, Erie, CO (US)

( * ) Notice: Subject to any disclaimer, the term of this patent is extended or adjusted under 35 U.S.C. 154(b) by 970 days.

(21) Appl. No.: 11/786,138

(22) Filed: Apr. 11, 2007

(65) Prior Publication Data

US 2007/0287354 A1 Dec. 13, 2007

Related U.S. Application Data

(63) Continuation-in-part of application No. 10/915,281, filed on Aug. 10, 2004, now abandoned.

(60) Provisional application No. 60/495,454, filed on Aug. 15, 2003.

(51) Int. Cl.
*A63H 33/04* (2006.01)

(52) U.S. Cl. ..... 446/85; 446/111; 446/108; 40/782

(58) Field of Classification Search ..... 40/782–785
See application file for complete search history.

(56) References Cited

U.S. PATENT DOCUMENTS

| | | | | |
|---|---|---|---|---|
| 1,678,602 | A | | 7/1928 | Oldfield |
| 3,600,825 | A | | 8/1971 | Pearce |
| 3,928,691 | A | * | 12/1975 | Knudson ..... 52/309.16 |
| 4,571,200 | A | | 2/1986 | Serna |

* cited by examiner

*Primary Examiner* — Gene Kim
*Assistant Examiner* — Urszula M Cegielnik
(74) *Attorney, Agent, or Firm* — Emery L. Tracy

(57) ABSTRACT

A panel device for use with a plurality of connectors and rods with the rods connectable to the connectors is provided. The panel device comprises a substantially planar panel member having a plurality of sides. A groove is formed along each side of the panel member. A first groove edge is positioned along one side of the groove. A second groove edge is positioned on the other side of the groove with the second groove edge extending beyond the first groove edge wherein each rod is adapted to be inserted into the groove, the first groove edge and the second groove edge releasably maintaining the rod within the groove.

14 Claims, 7 Drawing Sheets

PANELS FOR CONNECTOR AND ROD CONSTRUCTION TOY SETS

The present application is a continuation-in-part of pending U.S. patent application Ser. No. 10/915,281, filed Aug. 10, 2004 now abandoned, which claims benefit of priority of U.S. Provisional Patent Application Ser. No. 60/495,454, filed on Aug. 15, 2003.

BACKGROUND OF THE INVENTION

1. Field of the Invention

This invention relates generally to construction toys and, more particularly, the invention relates to an improved panel material and design for rod and connector construction toys.

2. Description of the Prior Art

Rod and connector style construction toys are well known in association with their respective trademarks, for example Tinkertoy™ manufactured by Playskool Inc., a division of Hasbro, Inc., FiddleStix™ manufactured by Toy N Things, and Zome™, manufactured by Zome Tool, Inc. These toys employ various linking means that permit connectors to join to rods to build composite, three-dimensional skeletal structures.

The prior art construction toys include a plurality of connector elements to be arranged with a plurality of rod elements to form coherent, skeletal structures. Typically, cylindrical rods are provided in graduated lengths allowing rectangular and triangular structures to be assembled in graduated sizes. The connectors are provided in a variety of configurations, having anywhere from one to eight sockets on a single connector part. Connectors can also be designed to be associated as multi-part assemblies with sockets radiating in more than one plane. When assembled, the rods are firmly gripped within the socket, which serve to position the rod element in alignment with the socket axis.

In the past, Playskool, a division of Hasbro, Inc., developed and marketed foam add-ons, called Foam Works™, with a TinkerToy™ construction set. However, these add-ons were not panels designed to fill skeletal structures. Toy N Things developed and marketed licensed add-on elements in a special Spiderman Fiddlestix™ construction set, but they also did not contain panels. The Gabriel, U.S. Pat. No. 4,129,975 had panel elements but these elements were not manufactured of foam and were either too costly to manufacture or resulted in heavily weighted structures unsuitable for children's play.

It is an objective of the present invention to provide panels that can be molded into a wide variety of possible shapes including, but not limited to rectangles, triangles, trapezoids, and octagons.

It is another objective of the present invention to provide panels that can be molded into three-dimensional objects.

It is another objective of the present invention to provide such panels as to allow lateral insertion and removal without distorting the skeletal structure of said construction sets.

It is another objective of the present invention to provide panels that are lightweight and safe for children to play with.

It is a further objective of the present invention to provide such panels as to allow auxiliary elements to be attached thereto.

It is a further objective of the present invention to provide such panels to flex to fit irregular planes.

It is still a further objective of the present invention to provide panels that are economical to manufacture.

For a more complete understanding of the above objectives and other features and advantages of the invention, reference should be made to the following detailed description of preferred embodiments and to the accompanying drawings.

SUMMARY

The present invention is a panel device for use with a plurality of connectors and rods with the rods connectable to the connectors. The panel device comprises a substantially planar panel member having a plurality of sides. A groove is formed along each side of the panel member. A first groove edge is positioned along one side of the groove. A second groove edge is positioned on the other side of the groove with the second groove edge extending beyond the first groove edge wherein each rod is adapted to be inserted into the groove, the first groove edge and the second groove edge releasably maintaining the rod within the groove.

In addition, the present invention is a method for constructing a toy set. The method comprises providing a plurality of rods, providing a plurality of connectors, connecting at least one rod to each connector forming a frame structure, providing a panel member, forming grooves on each edge of the panel member, compressing the panel member between the rods and the connectors within the frame, and receiving a rod in each of the grooves.

The present invention further includes a toy set. The toy set comprises a plurality of rods and a plurality of connectors with each rod being receivable within at least one of the connectors. At least one compressible panel having edges is provided with grooves formed along the edges wherein the panel members are compressible between the rods and wherein each rod is receivable within at least one of the grooves.

DETAILED DESCRIPTION OF THE PREFERRED EMBODIMENTS

Figure 1:
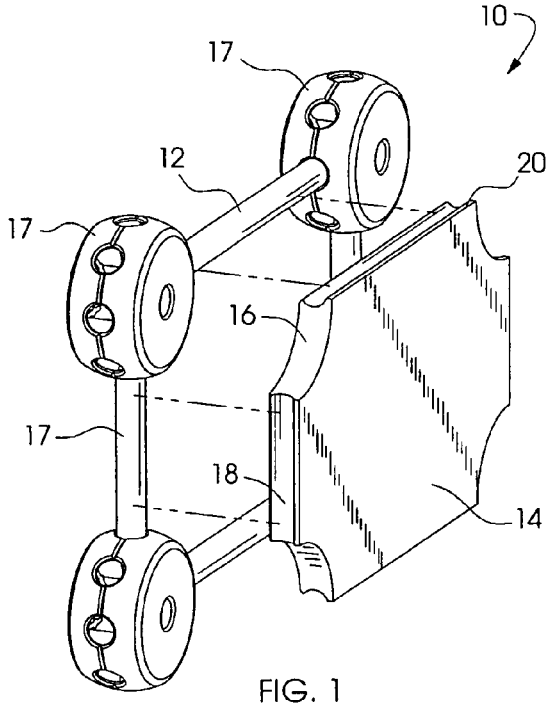
FIG. 1 is an exploded perspective illustrating a panel from assembled connector and rod elements, constructed in accordance with the present invention, with details of grooved recesses for the assembly of the panel.

As illustrated in FIGS. 1-16, the present invention are panels, indicated generally at 10, for connector and rod construction toy sets. Referring to FIG. 1, foam panels 14, which are illustrated as having a consistent thickness, are adapted for spanning between sets of rods 12 located in an array corresponding to the particular shaped panel 14. Located along edges of the panels 14 are grooves 18 shaped to match the radius of the rods 12 so that the panels 14 adhere to the rods 12 with the friction of contact. These side edges preferably extend the length of the panel 14 and serve to rigidify the panel 14 and to enclose the space.

The panel 14 advantageously is preferably formed of foam by injection molding, using pellets, or cut to shape from pre-formed sheets of material. Polymeric foams come in many variants. One particular foam material has demonstrated the resilience needed is ethylene vinyl acetate (EVA) foam. EVA is closed-cell polymeric foam and can be manufactured in varying densities. In particular embodiments, the foam panel density and thickness may be altered to achieve design goals such as curving the panel 14 to create the sail of a ship or increasing density and thickness for the tire of a truck. During insertion and removal the foam material compresses to allow the panel 14 to pass between sets of rods 12 without distorting the structure.

Figure 2:
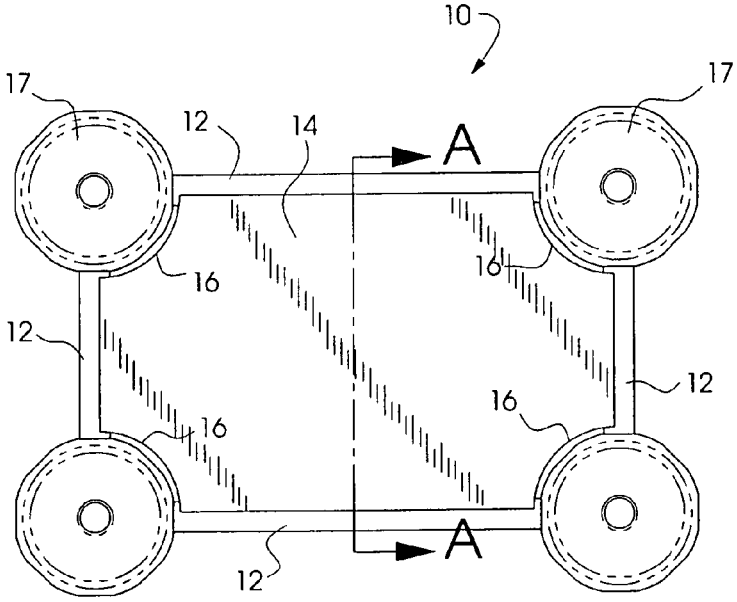
FIG. 2 is a top plan view illustrating a panel in assembly with the connector and rod elements, constructed in accordance with the present invention.

As illustrated in FIG. 2, the corner regions 16 of the panel are preferably contoured to match for cooperative association with various connector elements 17.

Figure 4:
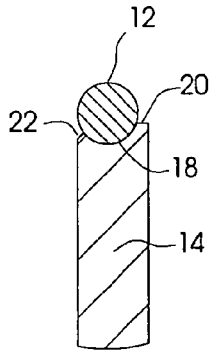
FIG. 4 is a fragmentary sectional view illustrating a panel assembly with a rod element as taken within section 4 of FIG. 3.
Figure 3:
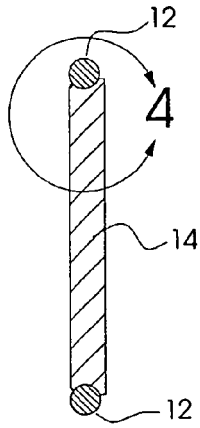
FIG. 3 is a sectional view illustrating a panel between opposing rod elements taken along line A-A of FIG. 2.
Figure 9:
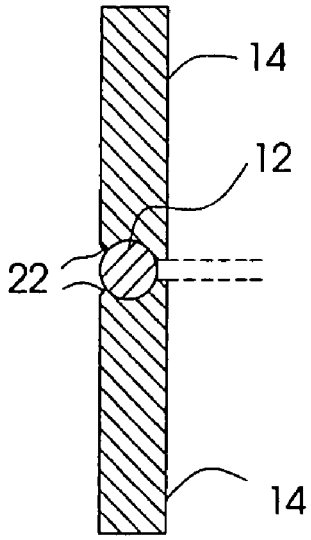
FIG. 9 is a fragmentary sectional view illustrating two panels connected to one rod at one hundred and eighty (180°) degrees.

Referring to FIGS. 3 and 4, located along the panel front edge, adjacent to the groove, an offset projection 20 inhibits the panel from pushing through the frame structure during insertion. The length of the offset projection may vary and is dependent on usage, but typically would allow for a ⅛" space between two parallel panels attached to the same rod to allow a panel to be gripped and removed as shown in FIG. 9. Located on the back edge, and also adjacent to the groove, is a beveled edge 22 which is adapted to make alignment during insertion easier and to allow two of the panels 14 to be attached to the same rod 12 perpendicularly. Preferably, the beveled edge 22 is approximately forty-five (45°) degrees.

Figure 5:
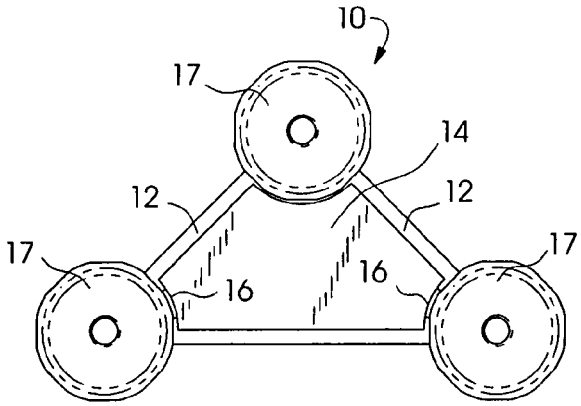
FIG. 5 is a plan view illustrating a triangular panel assembly, constructed in accordance with the present invention.
Figure 6:
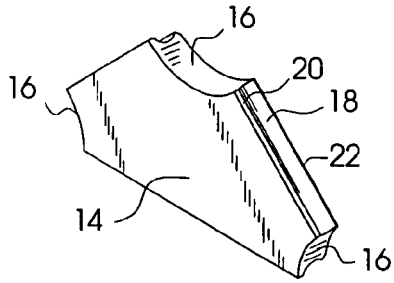
FIG. 6 is a perspective view illustrating the triangular panel in FIG. 5.

FIGS. 5 and 6 illustrate triangular panels 14 in the preferred form of the invention with the grooved portions 18 parallel to each respective rod 12 and the corner regions 16 similarly contoured to match for connectors 17 in the corner regions.

Figure 7:
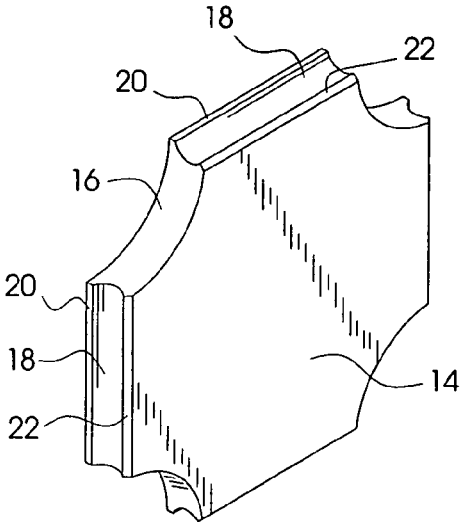
FIG. 7 is a perspective view illustrating a square panel, constructed in accordance with the present invention.

With reference now to FIG. 7 of the drawings, there is illustrated a square panel from the back with the groove 18, offset projection 20, and beveled edge 22 extending substantially entirely around the length the peripheral edges of said panel 14.

Figure 8:
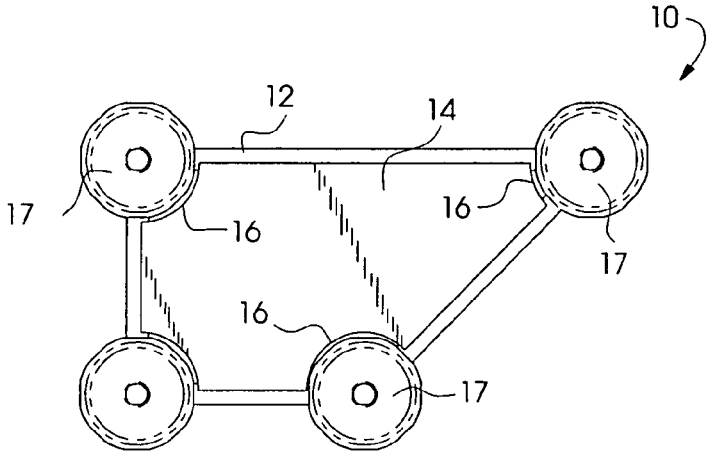
FIG. 8 is a plan view illustrating a trapezoidal panel, constructed in accordance with the present invention.

As illustrated in FIG. 8, a panel 14 is formed to fill a trapezoidal area, as defined by the connectors 10 and rods 12, in which the corner regions 16*d*, 16*e*, and 16*f* are sized and shaped to correspond to the configuration of the connector elements 17 in the trapezoidal space.

Figure 10:
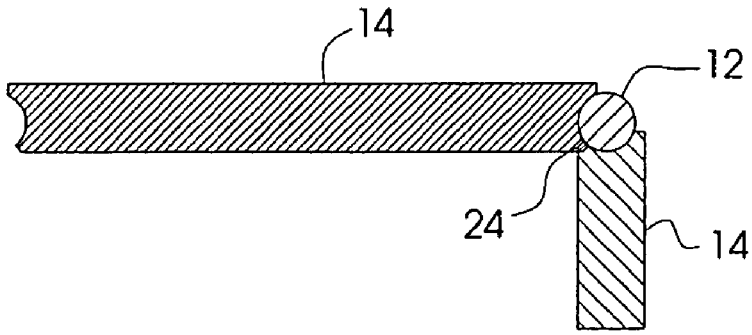
FIG. 10 is a fragmentary sectional view illustrating two panels connected to one rod at ninety (90°) degrees.

As illustrated in FIG. 10, beveled edges allow two panels 14 to be attached to the same rod perpendicularly, forming and inside corner 24 where the foam material of the panel 14 compresses. As illustrated, a first surface of the panel 14 extends above the rod 12 while a second surface of the panel 14 is substantially flush with the rod.

Figure 11:
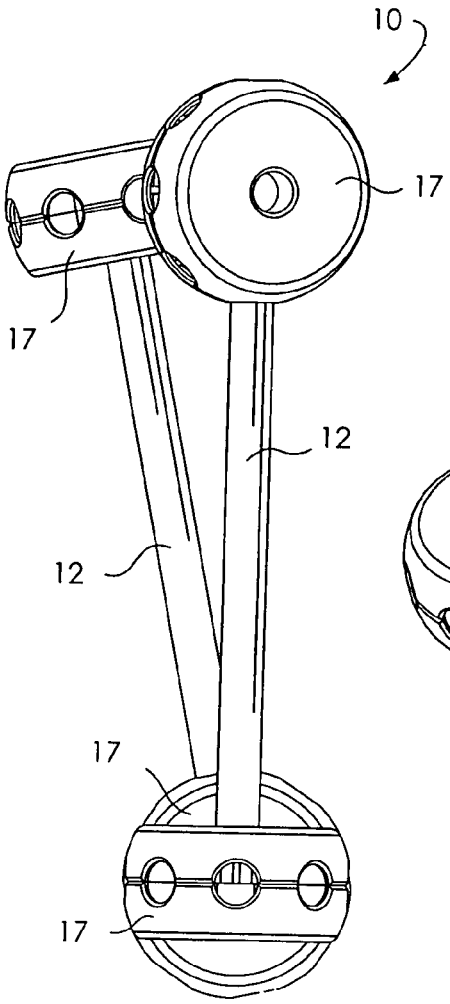
FIG. 11 is an elevational side view illustrating a twisted rod and connector frame structure, constructed in accordance with the present invention.
Figure 12:
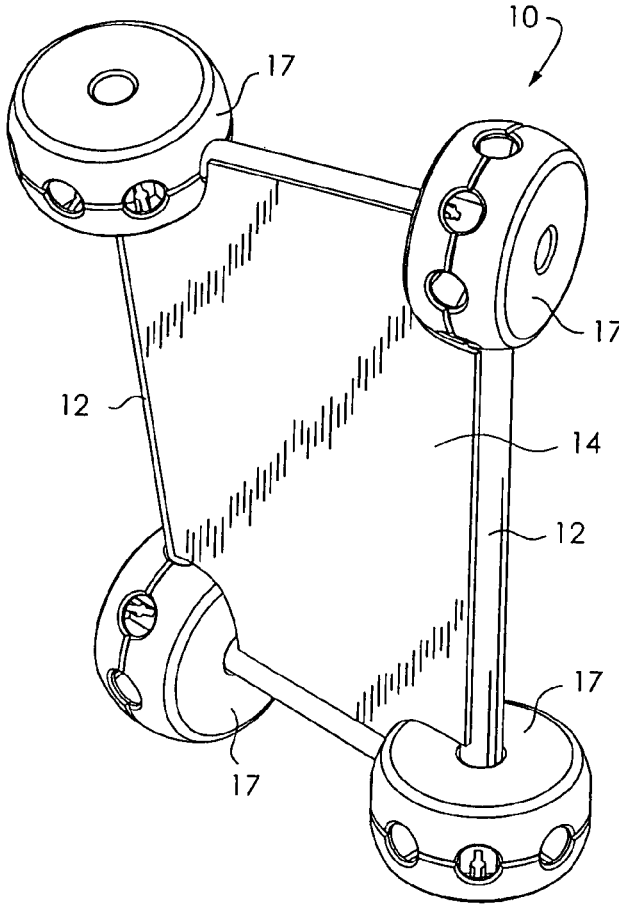
FIG. 12 is a perspective view illustrating a panel fitting the non-planar frame structure in FIG. 11.

FIGS. 11 and 12 illustrate a resilient flat panel 14 deformed to fit an irregular plane. The rod 12*e* and connector 17*e* twisted substantially away from perpendicular alignment with the rod 12*f* and connector 17*f*. The panel 14*e* flexes to fit the irregular frame structure without dislodging from said structure.

Figure 13:
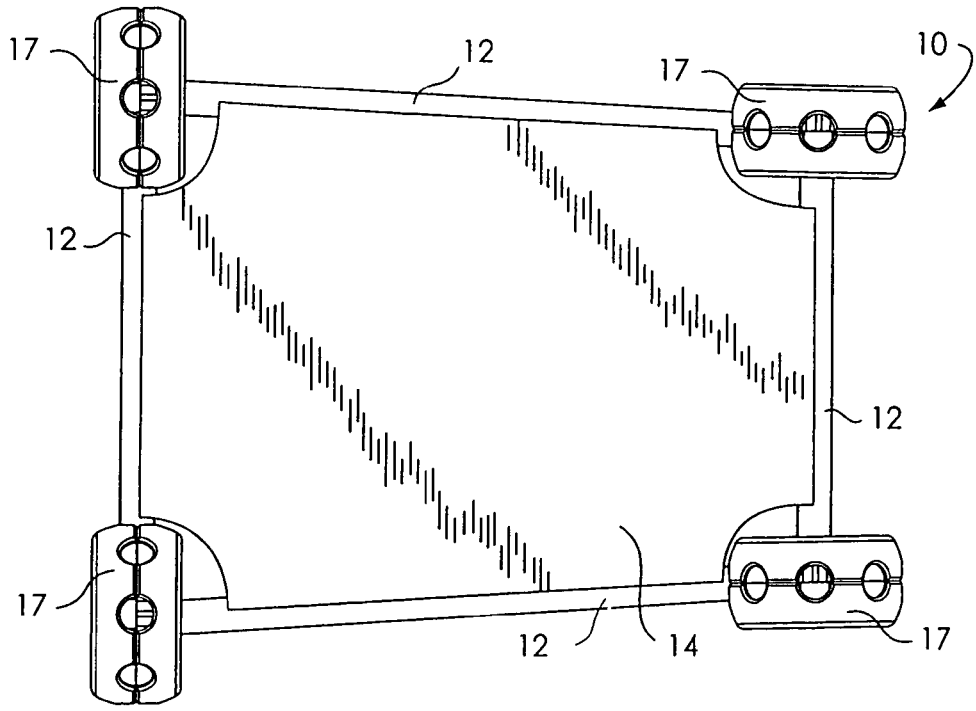
FIG. 13 is a plan view illustrating a rectangular panel compressed to fit a trapezoidal area, in accordance with the present invention.
Figure 14:
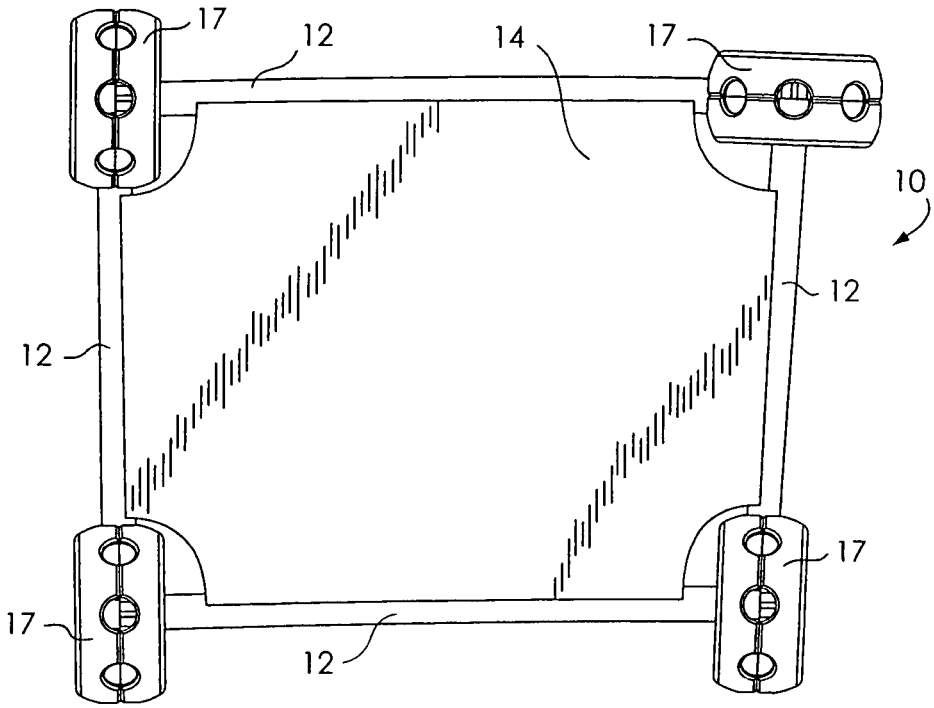
FIG. 14 is a plan view illustrating the rectangular panel in FIG. 13 fitting another trapezoidal area, in accordance with the present invention.

With reference now to FIGS. 13 and 14 of the drawings, in another preferred embodiment, the panels 14 can be formed of lower density foam to compress to fit between trapezoidal areas of the type that can be made by rotating one or more connectors 17 from perpendicular alignment. In FIG. 13 the two connectors 17*g* are rotated 90 degrees from perpendicular alignment with two remaining connectors 17*f* in the trapezoid. The rods 12*f* and 12*g* are of the same length as are the rods 12*h*. A rectangular panel 14*f* is compressed to fit the trapezoidal area without dislodging the structure. In FIG. 14, the same rectangular panel 14*f* used in FIG. 13 spans a second trapezoidal area where a single connector 17*g* is turned 90 degrees from perpendicular alignment with the other three connectors 17*f*.

Figure 15:
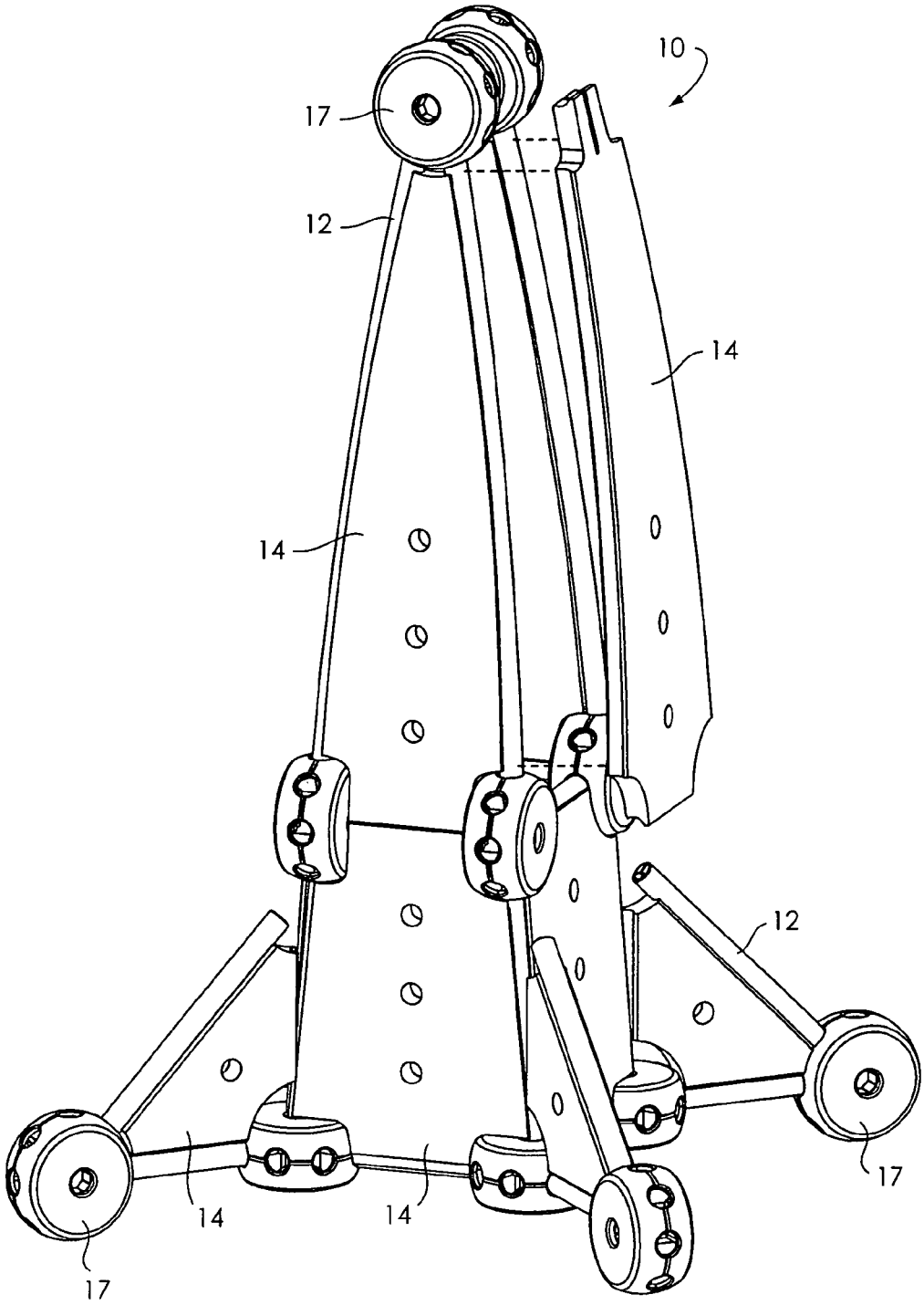
FIG. 15 is a perspective view illustrating a planar panel curved to fit along a structure, in accordance with the present invention.
Figure 16:
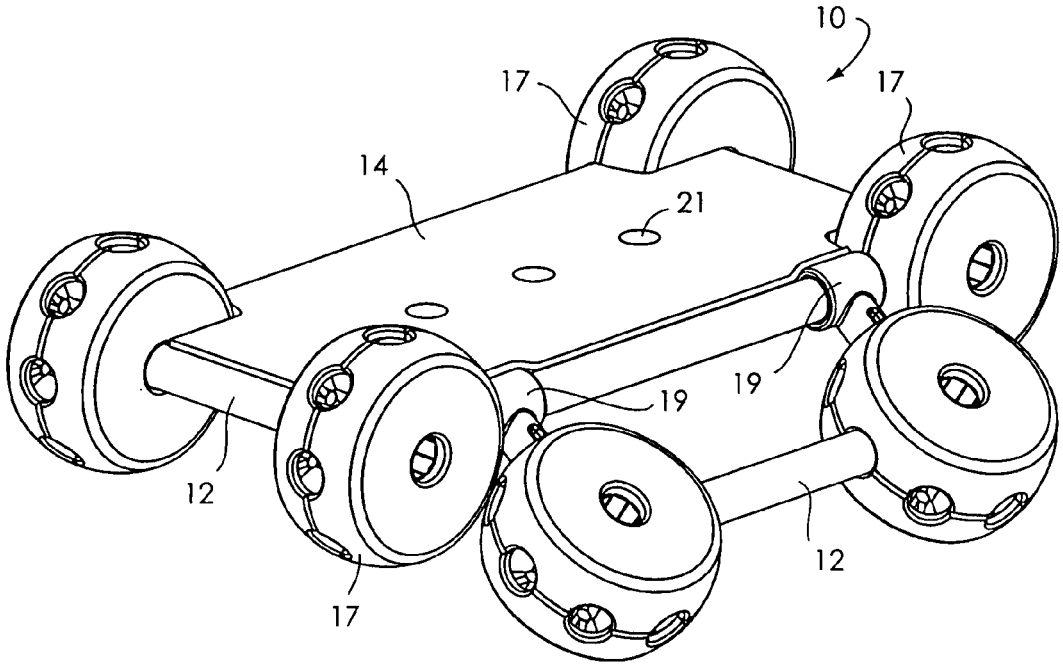
FIG. 16 is a perspective view illustrating a panel deformable over connectors along the rod, in accordance with the present invention.

As illustrated in FIG. 15, the panel 14 is flexible to curve along a structure. As illustrated in FIG. 16, the panel 14 is adapted to deform over connectors 19 along the rod 12. The rod holding the connectors 19 remains in the grooves. In fact, in a preferred embodiment, although not necessarily required, the rod 12 holding the connector 19 can remain completely positioned within the groove while deformed about the connector 19. Furthermore, apertures 21 can be formed in the panels 14 for receiving additional pieces (not shown).

In an alternative embodiment of the invention, panels 14 or any portion of the panels 14 can be color coordinated with rods of the construction sets. The color coordination of the panel edges assists the child in building a desired toy set.

Although the invention has been described with reference to specific examples, it will be appreciated by those skilled in the art, that the invention may be embodied in many other forms without departing from the clear teachings of the disclosure.

CONCLUSION

The present invention is directed to the use of a novel and advantageous material for the design and construction of panel elements that are adapted and incorporated into a frame structure of the type described above. The panels are designed in a manner to allow enclosure or partial enclosure of frame structures to form an integral part of and thus enhance such structures. To this end, panel elements according to the invention are formed of foam material that is either injection molded or cut to shape from pre-formed sheets of the material. The panels may take a variety of polygonal shapes, most typically in the form of a square, rectangle or right isosceles triangle. The panel material is typically molded into a flat central area bounded by side edges. Adjacent side edges define corner regions, which are cut or molded for cooperative association with connector elements described above. At each panel edge there is molded an integral concave surface to match the corresponding rod element, being thus adapted for lateral snap-fit assembly between at least one opposing pair of rod elements.

To advantage, during lateral insertion, the foam panel material compresses to fit between rod elements without forcing the rod elements out of their corresponding connectors. The panel elements of the invention can be readily incorporated in and/or removed from existing complex frame structures without the necessity of distorting the structure. Also to advantage, the panel will remain in place when the frame structure is twisted substantially outside of a flat plane as is often called for when building with said construction sets. The resiliency of the panel allows for it to be used in a plurality of instances, with a single panel fitting planar and non-planar areas in addition to rectangular and trapezoidal areas. When assembled, the panels are an integral part of the structure and can be utilized both in conjunction with and, in some cases, in place of a rod element.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A panel device for use with a plurality of connectors and rods, the rods connectable to the connectors forming a frame, the panel device comprising:

a planar panel member having a first surface, a second surface, and a plurality of sides, each of the first surface and the second surface being completely flat; and a groove formed in each side of the panel member completely between the first surface and the second surface, the groove having a first groove edge along the first surface and a second groove edge along the second surface;

wherein each planar panel member is insertable into the frame, each rod receivable within a groove; and wherein the second groove edge extends beyond the first groove edge.

2. The panel device of claim 1 wherein the planar panel member is constructed from a resilient material.

3. The panel device of claim 2 wherein the first groove edge compresses for receiving the rod into the groove and the second groove edge limits the extent of the rod within the groove.

4. The panel device of claim 1 wherein the planar panel member is curvable along a curved rod structure.

5. The panel device of claim 1 and further comprising:

an extension connector receivable along at least one of the rods;

wherein the second groove edge is deformable about the extension connector, at least a portion of the rod holding the extension connector remaining positioned with the groove.

6. The panel device of claim 5 wherein each panel member is moldable about connectors positioned on the rods.

7. The panel device of claim 1 wherein corners of the panel member are shaped around the connectors, the panel member being free from contact with the connectors.

8. The panel device of claim 1 wherein the first edge is beveled in a general direction upward away from the first surface toward the groove to an approximately forty-five (45°) degree angle.

9. The panel device of claim 1 wherein at least a portion of the panel member is substantially the same color as the associated rod.

10. The panel device of claim 1 wherein the rods are maintained within the grooves by friction.

11. The panel device of claim 1 wherein at least two panels are connectable to a single rod at an angle equal to or greater than ninety (90°) degrees.

12. The panel device of claim 1 wherein the each of grooves have radius substantially equal to the radius of the rods.

13. A panel device for use with a plurality of connectors and rods, the rods connectable to the connectors forming a frame, the panel device comprising:

a planar panel member having a first surface, a second surface, and a plurality of sides; and a groove formed along each side of the panel member, each groove has a first groove edge along the first surface and a second groove edge along the second surface, the second groove edge extending beyond the first groove edge;

wherein each panel member is insertable into the frame of rods and connectors, the first groove edge and the second groove edge releasably maintaining the rod within a groove;

wherein the first edge is beveled in a general direction upward away from the first surface toward the groove; and wherein the second surface of the panel extends above the rods and the first surface of the panel is substantially flush with the rods.

14. The panel device of claim 13 wherein the first groove edge compresses for receiving the rod into the groove and the second groove edge limits the extent of the rod within the groove.

* * * * *